United States Patent [19]

Ela et al.

[11] Patent Number: 4,633,361

[45] Date of Patent: Dec. 30, 1986

[54] CHUCK CONTROL FOR A WORKPIECE HOLDING ELECTROMAGNET

[75] Inventors: Roger B. Ela, Spencer; Dominic F. Pignataro, Shrewsbury, both of Mass.

[73] Assignee: Walker Magnetics Group, Inc., Worcester, Mass.

[21] Appl. No.: 656,312

[22] Filed: Oct. 1, 1984

[51] Int. Cl.[4] ..... B25B 11/00; H01F 13/00

[52] U.S. Cl. ..... 361/145; 361/149

[58] Field of Search ..... 361/145, 149

[56] References Cited

U.S. PATENT DOCUMENTS

| | | | |
|---|---|---|---|
| 2,229,104 | 1/1941 | Littwin | 175/187 |
| 2,825,854 | 6/1958 | Littwin | 317/157.5 |
| 2,946,932 | 7/1960 | Littwin | 317/157.5 |
| 3,045,151 | 7/1962 | Littwin | 317/157.5 |
| 3,078,396 | 2/1963 | Engelsted | 317/157.5 |
| 3,086,148 | 4/1963 | Soneki | 317/157.5 |
| 3,129,369 | 4/1964 | Littwin | 318/282 |
| 3,136,216 | 6/1964 | Littwin | 90/11 |
| 3,209,891 | 10/1965 | Littwin | 198/41 |
| 3,213,342 | 10/1965 | Littwin | 318/286 |
| 3,218,522 | 11/1965 | Littwin | 317/157.5 |
| 3,246,569 | 4/1966 | Littwin | 90/11 |
| 3,247,434 | 4/1966 | Littwin | 318/282 |
| 3,274,452 | 9/1966 | Landes | 317/157.5 |
| 3,300,688 | 1/1967 | Callinan | 317/123 |
| 3,340,407 | 9/1967 | Sinclair | 307/101 |
| 3,360,694 | 12/1967 | Littwin | 317/142 |
| 3,368,119 | 2/1968 | Littwin | 317/157.5 |
| 3,378,734 | 4/1968 | Littwin | 317/157.5 |
| 3,401,313 | 9/1968 | Littwin | 317/157.5 |
| 3,412,259 | 11/1968 | Schept | 307/101 |
| 3,417,295 | 12/1968 | Littwin | 317/123 |
| 3,445,620 | 5/1969 | Littwin | 219/108 |
| 3,473,287 | 10/1969 | Littwin | 53/35 |
| 3,478,876 | 11/1969 | Littwin | 209/73 |
| 3,482,163 | 12/1969 | Peek et al. | 324/117 |
| 3,517,911 | 3/1971 | Littwin | 29/558 |
| 3,532,940 | 10/1970 | Schroeder | 317/157.5 |
| 3,564,292 | 2/1971 | Littwin | 307/305 |
| 3,571,911 | 3/1971 | Littwin | 29/558 |
| 3,573,586 | 4/1971 | Littwin | 318/579 |
| 3,579,053 | 5/1971 | Littwin | 317/157.5 |
| 3,588,624 | 6/1971 | Marvin | 317/157.5 |
| 3,588,651 | 6/1971 | Littwin | 318/266 |
| 3,590,351 | 6/1971 | Littwin | 318/211 |
| 3,609,465 | 9/1971 | Gruetzmacher | 317/157.5 |
| 3,619,729 | 11/1971 | Littwin | 317/157.5 |
| 3,626,255 | 12/1971 | Littwin | 317/157.5 |
| 3,638,074 | 1/1972 | Inouye | 317/148.5 |
| 3,723,825 | 3/1973 | De Viney | 317/123 |
| 3,729,658 | 4/1973 | Voitov | 317/157.5 |
| 3,733,524 | 5/1973 | Cooksey et al. | 317/157.5 |
| 3,769,565 | 10/1973 | Littwin | 318/380 |
| 3,774,050 | 11/1973 | Littwin | 307/66 |
| 3,803,768 | 4/1974 | Littwin | 51/93 |
| 3,821,613 | 6/1974 | Fauve | 317/157.5 |
| 3,859,573 | 1/1975 | Siems et al. | 317/157.5 |
| 3,895,270 | 7/1975 | Maddox | 317/157.5 |
| 3,968,986 | 7/1976 | Nagata | 294/65.5 |
| 4,370,693 | 1/1983 | McDonald et al. | 361/145 |

*Primary Examiner*—L. T. Hix
*Assistant Examiner*—David M. Gray
*Attorney, Agent, or Firm*—Pahl, Lorusso & Loud

[57] ABSTRACT

An electromagnet control apparatus having a remote control switch assembly switchable between a number of positions representing full, variable, residual and zero levels of magnetization. Means are provided for causing the electromagnet to be fully energized for several seconds before being dropped to the residual level of magnetization whenever the switch assembly is switched to a residual setting.

13 Claims, 2 Drawing Figures

CHUCK CONTROL FOR A WORKPIECE HOLDING ELECTROMAGNET

BACKGROUND OF THE INVENTION

This invention relates to demagnetizing apparatus for electromagnets and workpieces held thereby and more particularly to such apparatus which is capable of demagnetizing a plurality of workpieces so as to allow removal of each workpiece without affecting the other workpieces.

In many environments in which an electromagnet is used for holding a workpiece, it is necessary to provide some means for demagnetizing the electromagnet and a workpiece held thereby before the workpiece can be readily removed from the holding magnet. Otherwise, the residual magnetism left in both the magnet and the workpiece may be sufficient to inhibit easy removal of the workpiece from the magnet. One example of such a situation is where an electromagnetic chuck is used for holding one or a plurality of workpieces for a grinding operation.

U.S. Pat. No. 4,370,693, assigned to the assignee of the present invention and incorporated herein by reference, discloses a demagnetizing apparatus for a workpiece-holding electromagnet. This demagnetizing apparatus includes switching means which can switch the magnetic hold of the electromagnet between various states of magnetization corresponding to full, variable, residual, and zero levels of magnetization.

The embodiment disclosed by U.S. Pat. No. b 4,370,693 specifically includes four switch positions designated FULL, VARIABLE, RESIDUAL and RELEASE. In the FULL switch position, maximum rectified a.c. power is transmitted to the electromagnetic chuck winding in order to provide the greatest holding power for the workpiece. When the switch is in the RESIDUAL position the holding power of the electromagnet is reduced, but not demagnetized, to a level that would allow one of a collection of workpieces to be removed when a multiplicity of workpieces are being machined or ground down at one time.

In some cases, it may be desirable to firmly hold a smaller workpiece without exerting FULL holding power, e.g., where such power might distort the workpiece. The VARIABLE setting is provided for this purpose. This switch position provides a preselected level of magnetization, the level typically selected to be less than FULL but substantially greater than the so-called RESIDUAL setting.

If it is desired to completely release the workpiece or workpieces, the control switch S1 may be moved to the RELEASE position to effect automatic demagnetization of the electromagnetic chuck and any permeable workpiece held thereby.

The RESIDUAL setting does not, however, always provide sufficient magnetism to hold the workpiece in place. When the chuck control is switched from a low level of VARIABLE holding to the RESIDUAL mode, the resulting residual magnetic holding force may be less than the minimum holding force intended to be supplied by the RESIDUAL mode. As a result, an operator may have handling problems with the workpieces since the non-maneuvered workpieces may shift.

Among the several objects of the present invention may be noted the provision of such an apparatus which will insure that a chuck will always achieve maximum residual magnetic holding force when in the RESIDUAL mode; the provision of such apparatus which is highly reliable and which is of relatively simple and inexpensive construction. Other objects and features will be in part apparent and in part pointed out hereinafter.

SUMMARY OF THE INVENTION

Briefly, apparatus constructed in accordance with the present invention includes means for magnetizing and demagnetizing an electromagnet and a workpiece held thereby. Demagnetization is achieved by a step wise adjustment of the phase setting of the power control means in order to control the average a.c. voltage applied to a full wave bridge rectifier through which the electromagnet is energized. The apparatus includes a control assembly for switching between states providing varying levels of magnetization to the chuck. The various states correspond to full, variable, residual and zero levels of magnetization applied to the chuck. When the control assembly is switched to the residual state, the circuitry provided by the present invention causes the output of the control to initally fully energize the electromagnet for several seconds before dropping to the residual level of magnetization.

BRIEF DESCRIPTION OF THE DRAWINGS

Corresponding reference characters indicate corresponding parts throughout the several views of the drawing.

DESCRIPTION OF THE PREFERRED EMBODIMENT

Figure 1:
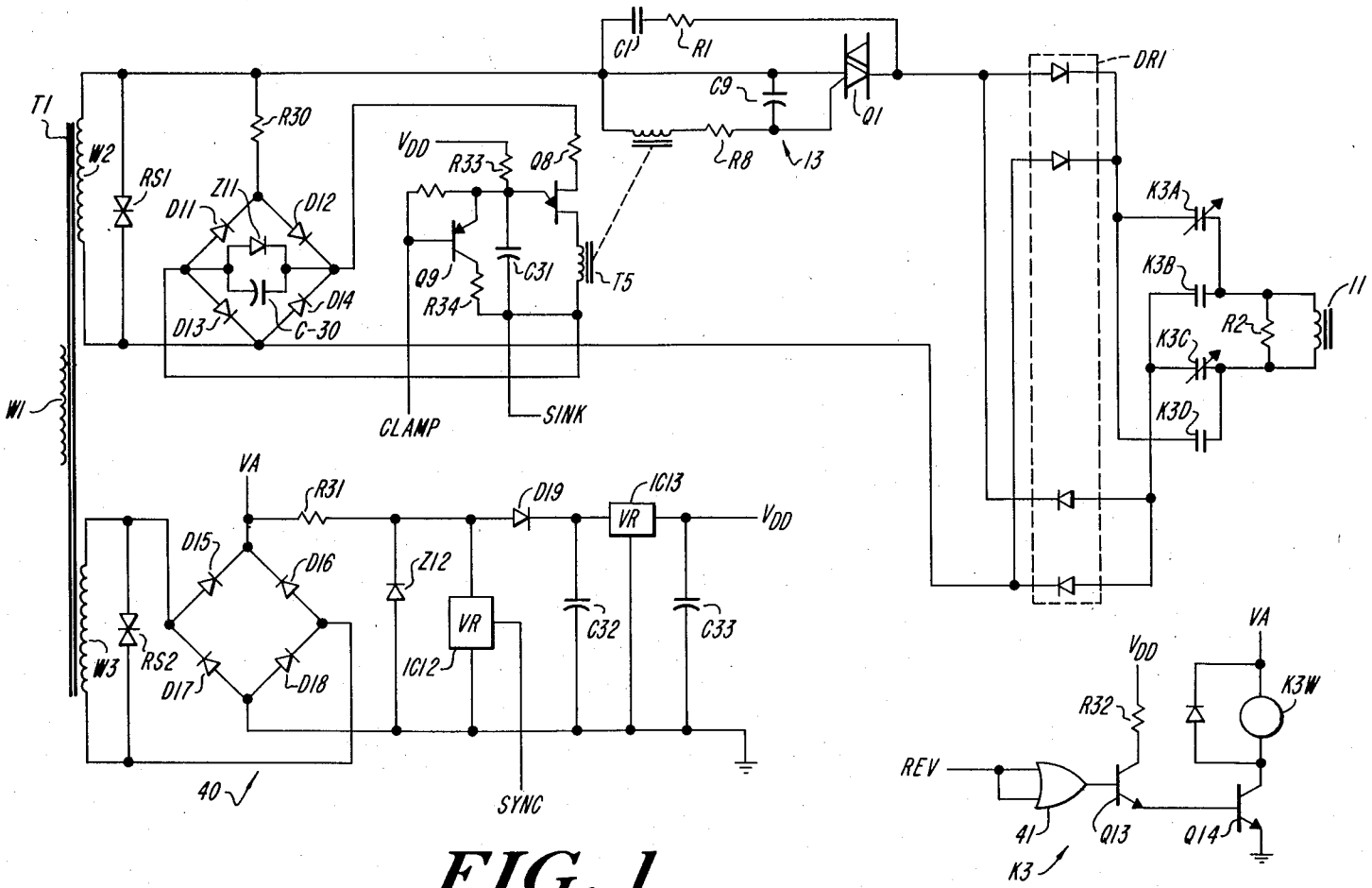
FIG. 1 is a schematic diagram of the power handling components of the demagnetizing apparatus constructed in accordance with the present invention.
Figure 2:
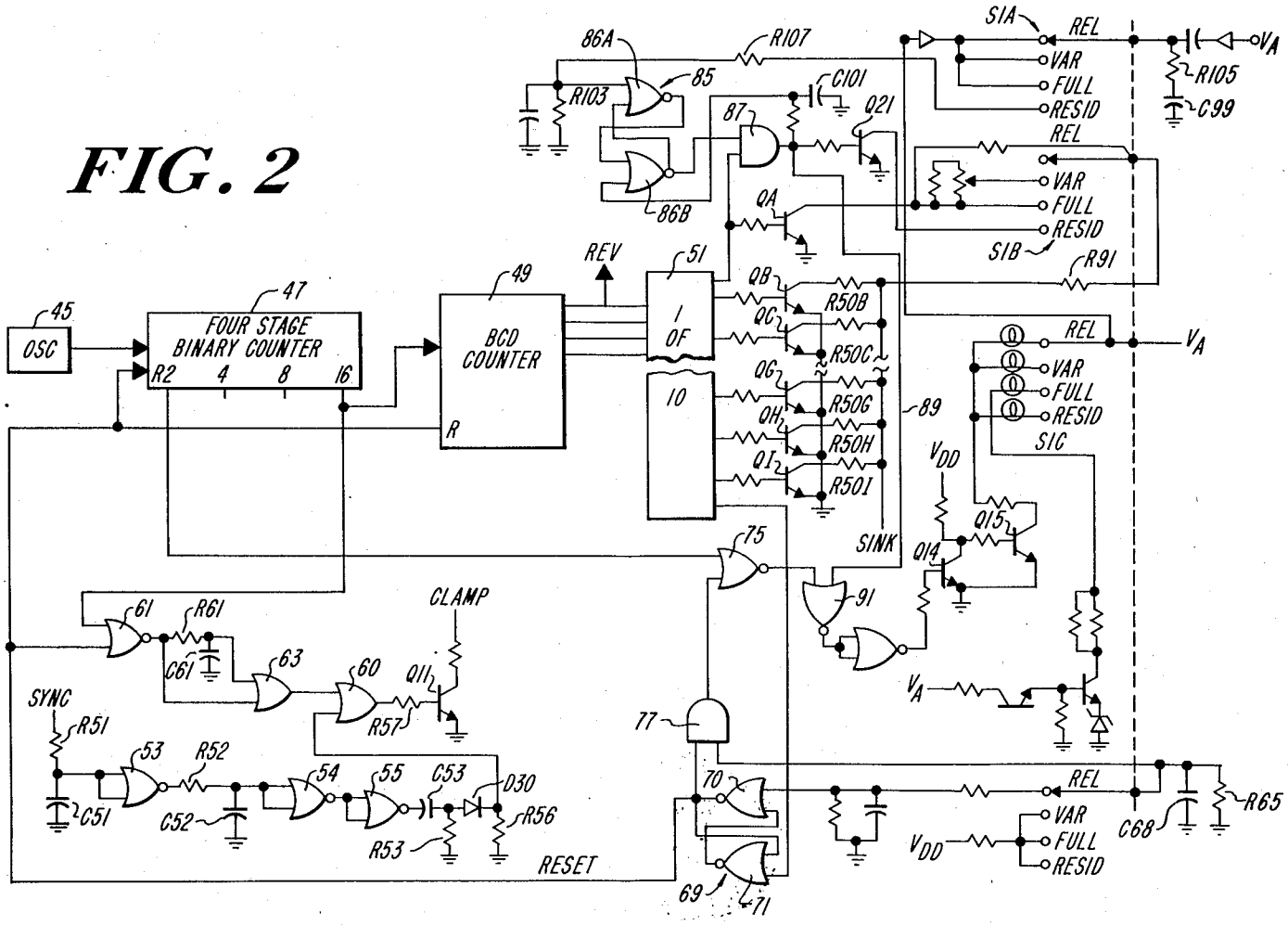
FIG. 2 is a schematic circuit diagram of the control circuitry of the demagnetizing apparatus of FIG. 1.

The control circuitry illustrated in FIGS. 1 and 2 is adapted for controllably energizing an electromagnetic chuck having an energizing winding 11. The controller itself includes a phase sensitive a.c. power control or modulator means 13, a bridge rectifier DR-1 for converting the variable a.c. provided by control circuit 13 to direct currents suitable for application to winding 11 and a reversing relay K3 having contacts K3A–K3D connected for controlably reversing the direction in which the direct current is applied to the winding. The controller also includes sequential switching means which operates both to progressively change the phase setting of the power control means and to periodically reverse the polarity of magnetization produced by the chuck winding 11. Operator control is exercised over the electromagnetic controller circuitry by means of a remote control assembly.

Referring now to FIG. 1, a step-up and isolation transformer T1 provides, by means of a secondary winding W2, a supply of voltage capable of, when rectified, fully energizing the electromagnet winding 11. Winding W2 is shunted by a suppressor RS1. The supply voltage obtained from winding W2 is modulated by the a.c. power control or modulator means 13 which employs a triac Q1 in a phase-sensitive power modulating circuit. The modulated a.c. power is rectified by a bridge DR1 and is applied to the magnet winding 11 through the contacts K3A–K3D on the reversing relay K3. The triac Q1 is selectively triggered by a unijunction transistor Q8 whose pulsatile output signal is applied to the gate of the triac through a transformer T5. The primary of the transformer is in series with the channel circuit of the unijunction transistor Q8 while the secondary is connected to the gate of the triac Q1 as illustrated. The operation of the unijunction transistor Q8 is synchronized with the triac Q1 by clamp transistor Q9. The unijunction transistor is energized with a full wave rectified version of the a.c. voltage applied across the triac circuit. Rectification is provided by a bridge comprising diodes D11–D14 while regulation is provided by a Zener diode Z11 shunting the open circuit of the bridge and resistor R30 provides voltage drop. Filtering is provided by a capacitor C30 connected across the Zener diode Z11.

The input circuit to the unijunction transistor Q8 is shunted by a timing capacitor C31. As will be understood by those skilled in the art, the time, within each a.c. half cycle, at which triggering of the triac will occur depends upon the rate at which capacitor C31 is charged. During demagnetization, this rate of charging is periodically adjusted in a stepwise fashion by the logic circuitry of FIG. 2, as described in greater detail hereinafter. At the outset, however, it may be noted that this control circuitry is in effect floated in potential so that it can control the charging current of capacitor C31 even though the unijunction circuit with which capacitor C31 is associated is directly connected to a rectified a.c. supply line.

An isolated power supply circuit for energizing the control circuitry, allowing its nominal ground to float, is indicated generally by reference character 40. Isolation is provided by a secondary winding W3. A suppressor RS2 is connected across this winding. A full wave bridge, comprising diodes D15–D18 provides full wave rectified a.c. The operating coil K3W of the reversing relay K3 is operated from the unfiltered section of this supply under control of the logic circuitry of FIG. 2. The logic signal controlling the reversing relay K3 is designated REV and is applied through a buffering gate 41 to a pair of Darlington-connected transistors Q13 and Q14 which control the coil K3W.

The full wave output from the bridge (D15–D18) is clipped by means of a Zener diode Z12, voltage dropping being provided by a resistor R31. A further clipped version of this full wave rectified signal is provided as a SYNC signal by means of an integrated circuit voltage regulator IC12. The regulator provides a precise maximum value of the wave form while maintaining synchronization with the a.c. supply. The signal is employed for various synchronization purposes described hereinafter. The clipped voltage obtained from the Zener diode Z12 is applied, through a diode D19 through a filter capacitor C32. This voltage is regulated by an integrated circuit voltage regulator IC13 to provide a voltage, e.g. 15 volts, suitable for energizing integrated circuit logic, additional filtering being provided by capacitor C33. This regulated supply voltage is designated $V_{DD}$ in conventional fashion. As shown in FIG. 1, the positive side of the current source which charges the unijuncition timing capacitor C31 is provided from this regulated voltage source, through a fixed resistor R33. The actual charging rate of the timing capacitor C31 is, however, controlled on the negative side. This variable current signal, obtained from the control circuitry of FIG. 2 is designated SINK i.e. for current sink. As is described in greater detail hereinafter, the charging rate is selectively controlled by the FIG. 2 circuitry to effect the level of energization desired in each mode of operation and in the successive state of demagnetization.

Timing capacitor C31 can be selectively discharged or reset by means of a switching transistor Q9 which shunts the capacitor C31, current limiting being provided by a resistor R34. The signal which controls this transistor is designated CLAMP and is likewise obtained from the control circuitry of FIG. 2.

Referring now to FIG. 2, the control circuitry illustrated therein employs an oscillator operating at a high frequency. This oscillator is indictated by reference character 45. Oscillator 45 drives a 4-stage, i.e. divide by 16, counter 47. The output from the last stage of binary counter 47 is applied to advance a BCD (Binary Coded Decimal) counter 49. BCD counter 49 is a device which actually defines the successive states in the progressive demagnetization performed in accordance with the present invention. For the purpose of obtaining successive, discretely defined states, the BCD coded output signals from the counter 49 are applied to a 1-of-10 decoder 51. Each of the first nine of the output signals from decoder 51 controls, through a respective current limiting resistor, a respective switching transistor QA–QI. The collectors of switching transistors QB–QI are connected to the SINK lead through respective current controlling resistors R50B–R50I.

The operation of the decoder 51 is such that only one of the switching transistors QA–QI is turned on at any one time and thus the current drawn through the SINK line can be uniquely determined by adjusting the value of the respective resistor R50B–R50I. As indicated previously, the current drawn through the SINK line determines the phase at which the unijunction transistor Q8 triggers the triac Q1 so as to control the power provided to the magnet.

The SYNC signal obtained from the isolated power supply 40 is delayed by an RC network comprising resistor R51 and capacitor C51 and, after buffering by a NOR gate 53, is further delayed by an RC network comprising resistor R52 and capacitor C52. After further buffering by a pair of NOR gates 54 and 55, which effect a "squaring up" of this signal, a differentiation is performed by a capacitor-resistor network comprising capacitor C53 and resistor R53. The positive-going portion of the resultant spike signal is selected by means of a diode D30, ground reference being maintained by a resistor R56. This positive-going spike is applied as one input to an OR gate 60 which selectively energizes, through a resistor R57, switching transistor Q11 which provides the CLAMP signal. By appropriately adjusting the delays effected by the various RC networks, this positive-going pulse signal is caused to appropriately coincide in time with the zero crossings of the a.c. supply voltage and thereby effect synchronization of the operation of the unijunction triggering circuit with the a.c. supply.

The clamping curcuit also operates to inhibit operation of the unijunction triggering circuit at the start of each period of energization. The output signal from the last stage of binary counter 47 is applied as one input to a NOR gate 61. The output signal from gate 61 is applied directly as one input to an OR gate 63 and, through a delay network comprising resistor R61 and capacitor C61, as the other input to that same gate. The output signal from OR gate 63 is applied as the second input to OR gate 60 and can thus also energize the clamp transistor Q9. The undelayed signal provided to gate 63 assures that the triggering circuit will be turned off promptly at the end of each step of de-energization while the delay introduced by resistor R61 and capacitor C61 delays the re-energization of the triggering circuit and likewise delays the reapplication of power to the magnet until any arcing at the contacts of the reversing relay has died out.

Referring to FIG. 2, the control circuitry illustrated therein is actuated by a four position switch having four sets of contacts, S1A, S1B, S1C, and S1D. The four positions of each switch correspond to states of the apparatus of FULL magnetization, VARIABLE magnetization, RESIDUAL magnetization and RELEASE or no magnetization.

When the selector switch S1A is in the RELEASE, VARIABLE or FULL position, capacitor C99 is charged by the $V_A$ supply voltage. Moving the selector switch to the RESIDUAL position then applies the power stored in capacitor C99, through resistors R105 and R107, to resistor R103 and to the flip-flop 85 comprising NOR gates 86A and 86B. This power is applied for an interval long enough to change the state of flip-flop 85 so that the flip-flop 85 produces a high output at the output terminal of NOR gate 86B which is the output terminal of the flip-flop 85. If the control is not also going through a RELEASE cycle, a high signal will also be supplied through the 1 of 10 decoder to the input of AND gate 87. As a result, the AND gate 87 has two high inputs thereby resulting in a high output from AND gate 87 which turns on transistor Q21.

Switching section S1B effects the current drawn through the SINK line and thus controls the level of energization. Therefore, when the selector switch S1B is also in the RESIDUAL position, current flowing out of capacitor C31 (FIG. 1) of the unijuntion circuit through the SINK line passes through the full output level resistor R91 and then to ground via the turned on transistor Q21. As a result, full output voltage is applied to the chuck.

At the same time transistor Q21 is turned on by the high output from AND gate 87, capacitor C101 is being charged. Within several seconds, capacitor C101, which is connected to the reset terminal of flip-flop 85, becomes sufficiently charged to reset the flip-flop 85. Flip-flop 85 becomes reset because there is no longer a high signal on the input of NOR gate 86A of flip-flop 85 because capacitor C99 has become discharged.

Once the flip flop 85 is reset, transistor Q21 is turned off, and the control output voltage becomes zero. As a result, the chuck is left in its maximum residual magnetic state.

Section S1C of the control switch controls the indicator lamps which signal the mode of operaton. Current is applied to a selected one of the lamps through the movable contact, as indicated, and the other sides of the lamps, except the FULL lamp, are selectively grounded through a cascading current-switching transistor Q14 and Q15. The switching transistors are controlled through a NOR gate 75. One input of the NOR gate 75 is obtained from AND gate 77 which obtains its inputs from the movable contact of switch section S1D and the RESET signal. Thus, if the RESET signal is present and the movable contact of sections S1D is in any position other than the RELEASE position, the selected lamp can be steadily energized.

However, at the same time the flip flop 85 is causing the control circuitry to deliver full output voltage while the switch is in the RESIDUAL position, the flip flop 85 is also blocking the residual light from becoming illuminated. This blocking action is initiated by a signal flowing from AND gate 87 through a bus 89 to one of the inputs of NOR gate 91. With selector switch S1D in the RESIDUAL position, $V_{DD}$ is connected to AND gate 77. With this high input on AND gate 77, the AND gate 77 generates a high output and therefore supplies a high input to NOR gate 75. The high input into NOR gate 75 results in a low output from NOR gate 75. As mentioned above, bus 89 supplies a high output to NOR gate 91, thereby causing the output of NOR gate 91 to go low. With a low output from NOR gate 91, the transistor Q15 is an "off" state. As a result, even though the selector switch S1C is in the RESIDUAL position, and therefore connecting the residual light to $V_A$, current cannot flow to the RESIDUAL light since transistor Q15 is turned off.

When the flip flop 85 becomes reset, after the magnetic winding has been fully charged, the signal carried across bus 89 becomes a low signal thereby reversing the state of NOR gate 91. As a result, transistor Q15 is turned on. With Q15 in an "on" state, the RESIDUAL light will become illuminated thereby indicating that the control output voltage has once again returned to a true residual state.

Full power of any intermediate value of magnetization may be provided on a steady or continuous basis by manually operating the control switch S1A–S1D to connect an appropriate value of resistance to the SINK lead. When the switch, however, is then moved to the RELEASE position, the voltage previously stored in capacitor C65 sets the flip-flop 69 comprising the gate 70 and 71 thereby withdrawing the RESET signal. At this point, the counters 47 and 49 are released and begin counting. As each of the transistors QA–QI is turned on in sequence, the corresponding current determining resistor R50A–R50I is connected to the SINK lead and the appropriate value of current is applied, through the phase sensitive modulating circuit to the magnet winding 11.

The least significant bit from the BCD counter 49 is applied as the REV signal which controls the reversing relay K3 so that the direction of magnetization on each successive step is reversed from its predecessor. Power is not immediately applied to the magnet at the start of each step since the delay introduced by network comprising R61 and capacitor C61 causes the CLAMP signal to be applied for a brief period at the start of each step, thereby inhibiting the unijunction trigger circuit for a period sufficient to extinguish arcing at the contacts of the reversing relay K3.

The output signal from the last stage of the decoder 51 is applied to reset the flip-flop 69 thereby restoring the RESET signal and re-establishing the initial condition. The demagnetization sequence will only be subsequently restarted if the control switch is moved away from the RELEASE position, allowing the capacitor C65 to be recharged, and then moved back to the RELEASE position so as to again trigger the RELEASE sequence of operations.

In view of the foregoing, it may be seen that several objects of the present invention are achieved and other advantageous results have been obtained. Specifically, it may be seen that applicant has provided an apparatus in which a true residual holding power can be obtained each time the control is switched from any switch position to the RESIDUAL position.

As various changes could be made in the above constructions without departing from the scope of the invention, it should be understood that all matter contained in the above description or shown in the accompanying drawings shall be interpreted as illustrative and not in a limiting sense. Furthermore, the present invention should not be limited to circuits utilizing integrated circuit logic devices. Similar apparatus employing triggerable semiconductor switching devices can also be modified so as to be guaranteed of achieving a true residual state.

We claim:

1. Apparatus for generating a sequence of energizations for a winding of an electromagnet used for securing a magnetizable workpiece, the apparatus comprising:

control switching means for switching the energization of the winding of the electromagnet between states corresponding to full, variable, residual, and zero states of magnetization;

means for initially fully energizing the winding of said electromagnet when said control switching means is initially switched to a residual state;

timing means associated with said means for fully energizing the winding of said electromagnet, said timing means allowing said electromagnet to reach said full state of magnetization for a selected period of time before being reduced to said residual state of magnetization when said control switching means is switched to said residual state.

2. The apparatus of claim 1 wherein said timing means comprises:

means for storing a charge when said control switching means is in a state of full, variable, or zero magnetization;

a second switching means actuated by said stored charge when said control switching means is switched to a residual state, said actuated second switching means allowing said electromagnet to be fully energized;

means for resetting said resettable second switching means after said electromagnet has been fully energized;

whereby when said second switching means is reset, said state of magnetization of said electromagnet drops to the residual state.

3. The apparatus of claim 2 wherein said means for storing a charge comprises:

a resistor-capacitor circuit charged by a supply voltage;

charge blocking means connected to said resistor-capacitor circuit when said control switching means is switched to a state of full, variable or zero magnetization.

4. The apparatus of claim 2 wherein said second switching means is a flip-flop.

5. The apparatus of claim 1 further comprising:

state-indicating lights, one of said lights corresponding to each of said states of magnetization, said lights being responsive to said control switching means;

means for delaying the illumination of said light corresponding to said residual state of magnetization until the state of magnetization of the electromagnet drops from the full state of magnetization to the residual state of magnetization.

6. Apparatus for generating a sequence of energizations for a winding of an electromagnet used for securing a magnetizable workpiece, the apparatus comprising:

control switching means for switching the energization of the winding of the electromagnet between states corresponding to full, variable, residual, and zero states of magnetization;

means for fully energizing the winding of said electromagnet when said control switching means is initially switched to a residual state;

means for storing a charge when said control switching means is in a state of full, variable, or zero magnetization;

a second switching means actuated by said stored charge when said control switching means is switched to a residual state, said actuated second switching means allowing said electromagnet to be fully energized;

means for resetting said second switching means after said electromagnet has been fully energized;

whereby when said second switching means is reset, said state of magnetization of said electromagnet drops to the residual state.

7. The apparatus of claim 6 wherein said means for storing a charge comprises:

a resistor-capacitor circuit charged by a supply voltage, charge blocking means connected to said resistor-capacitor circuit when said control switching means is switched to a state of full, variable or zero magnetization.

8. The apparatus of claim 6 wherein said second switching means is a flip-flop.

9. The apparatus of claim 6 further comprising:

state-indicating lights, one of said lights corresponding to each of said states of magnetization, said lights being responsive to said control switching means;

means for delaying the illumination of said light corresponding to said residual state of magnetization until the state of magnetization of the electromagnet drops from the full state of magnetization to the residual state of magnetization.

10. Apparatus for generating a sequence of energizations for a winding of an electromagnet used for securing a magnetizable workpiece, the apparatus comprising:

control switching means for switching the energization of the winding of the electromagnet between states corresponding to full, variable, residual, and zero levels of magnetization;

means for fully energizing the winding of said electromagnet when said control switching means is initially switched to a residual level;

a resistor-capacitor circuit charged by a supply voltage, charge blocking means connected to said resistor-capacitor circuit when said control switching means is switched to a state of full, variable or zero magnetization;

second switching means actuated by said stored charge when said control switching means is switched to a residual state, said actuated second switching means allowing said electromagnet to be fully energized;

means for resetting said second switching means after said electromagnet has been fully energized.

11. The apparatus of claim 10 wherein said second switching means is a flip-flop.

12. The apparatus of claim 10 further comprising:

state-indicating lights, one of said lights corresponding to each of said states of magnetization, said lights being responsive to said control switching means;

means for delaying the illumination of said light corresponding to said residual state of magnetization until the state of magnetization of the electromagnet drops from the full state of magnetization to the residual state of magnetization.

13. An apparatus for generating a sequence of energizations for a winding of an electromagent used for securing a magnetizable workpiece, the apparatus including phase-sensitive power control means providing alternating current of variable average voltage from a rectified a.c. supply voltage of fixed amplitude, a full wave rectifier means interconnected with said power control means for providing variable direct current from said variable alternating current, a current reversing switch circuit for connecting the d.c. output of said rectifier means to said electromagnet in either a forward or reverse direction, and sequential switching means having a first portion for progressively changing the phase setting of the power control means upon successive actuations and a second portion for reversing the polarity of magnetization of said magnet winding by a switch circuit upon successive actuations of said switching means and means for periodically actuating said sequential switching means, the improvement comprising:

an externally controlled selection means for switching the level of magnetization of the winding among a plurality of "hold" states and a "release" state, said "hold" states including states corresponding to full, variable and residual states of magnetization, said electromagnet in said residual state being provided with a minimum magnetization for holding said workpiece;

means for fully magnetizing the electromagnet when the selection means is initially switched to a residual state from any of said plurality of hold states, said magnetization dropping to said residual state after reaching said full magnetization state.

* * * * *